US007234408B1

(12) United States Patent
Clemmons et al.

(10) Patent No.: US 7,234,408 B1
(45) Date of Patent: Jun. 26, 2007

(54) WATER SPORT TOW ATTACHMENT WITH RECOIL

(76) Inventors: John Dale Clemmons, 22981 Sierra Trail, Canyon Lake, CA (US) 92587; Michael J. Murphy, 22981 Sierra Trail, Canyon Lake, CA (US) 92587

( * ) Notice: Subject to any disclaimer, the term of this patent is extended or adjusted under 35 U.S.C. 154(b) by 0 days.

(21) Appl. No.: 11/078,578

(22) Filed: Mar. 10, 2005

Related U.S. Application Data

(60) Provisional application No. 60/587,564, filed on Jul. 12, 2004, provisional application No. 60/632,999, filed on Dec. 3, 2004.

(51) Int. Cl.
*B03B 21/04* (2006.01)

(52) U.S. Cl. ..... 114/253; 114/364

(58) Field of Classification Search ..... 114/242–254, 114/364; 441/68
See application file for complete search history.

(56) References Cited

U.S. PATENT DOCUMENTS 2,816,310 A * 12/1957 Nale ..... 242/379.2
2,872,889 A * 2/1959 Johnson ..... 114/253
2,883,684 A * 4/1959 Correll ..... 114/382
2,924,193 A * 2/1960 Bridges ..... 114/253
2,972,325 A * 2/1961 Beltmann et al. ..... 114/253
3,034,469 A * 5/1962 Allen ..... 114/253
3,326,175 A * 6/1967 Baker ..... 114/254
3,919,963 A * 11/1975 Cox, III ..... 114/253
4,480,577 A * 11/1984 Naypaver ..... 114/253
6,119,617 A * 9/2000 Oswell ..... 114/253
6,192,819 B1 2/2001 Larson et al.
6,374,762 B1 4/2002 Larson et al.
RE37,823 E 9/2002 Larson et al.
6,666,159 B2 12/2003 Larson et al.
6,834,607 B1 12/2004 Johnson et al.

* cited by examiner

*Primary Examiner*—Ajay Vasudeva
(74) *Attorney, Agent, or Firm*—Blakely Sokoloff Taylor & Zafman LLP

(57) ABSTRACT

A pivot is coupled to a water craft. A lever arm is pivotally coupled to the pivot at one end. A tow spool is coupled to the lever arm at an end opposite the pivot. The tow spool is configured to provide an attachment for a towline. A recoil device is coupled to the water craft at one end and coupled to the lever arm at the opposing end. The recoil device stores energy as a towing drag force is applied to the tow spool to cause the lever arm to move from a first position to a second position. The recoil device then provides a restoring force to cause the lever arm to move from the second position to the first position as the towing drag force is reduced.

19 Claims, 4 Drawing Sheets

WATER SPORT TOW ATTACHMENT WITH RECOIL

CROSS REFERENCE TO RELATED APPLICATIONS

This application claims the benefit of application Ser. No. 60/587,564, filed Jul. 12, 2004, and of application Ser. No. 60/632,999, filed Dec. 3, 2004.

BACKGROUND OF THE INVENTION

Some water sports involve towing an enthusiast, such as but not limited to a water skier or a wakeboarder, with a boat using a towline coupled at one end to the tow boat and held by the enthusiast at the other end. A towed watersports enthusiast may achieve greater vertical lift when jumping if the towline is mounted relatively high vertically in the tow boat. Various means have been used to provide an elevated attachment point, such as extended pylons and wakeboard towers.

In addition to raising the height of the towline attachment to the tow boat, it has been found that towed watersports enthusiast performance can also be improved by providing a burst of additional speed to the towed watersports enthusiast as he jumps the boat's wake, for example. Typical tow boats cannot deliver such a burst of speed either quickly enough or strongly enough to help boost towed watersports enthusiast performance due to the inertia of the boat.

DETAILED DESCRIPTION OF THE INVENTION

Figure 1:
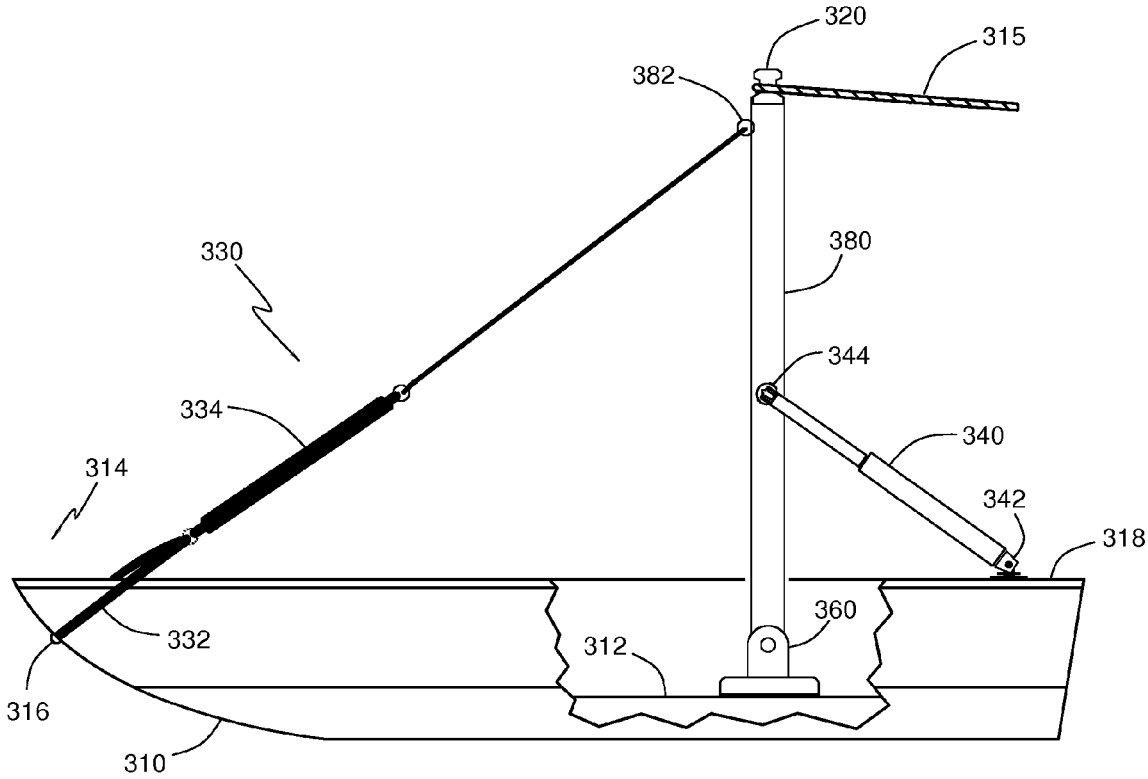
FIG. 1 is a side elevation of a rope attachment point that embodies the invention shown with a water craft, such as a tow boat.

The present device provides a rope attachment point for a water craft, such as a tow boat, to which may be attached a towline for towing a towed watersports enthusiast engaged in a water sport, such as, but not limited to water skiing or wake boarding. The device includes a lever arm attached at a first end to the towline, and at a second end to the water craft or to a structure fixed to the water craft, such as an elevated tow boat tower. The first end of the lever arm is movable between a first position and a second position, the second position being horizontally closer to a watersports enthusiast being towed by the rope. A recoil device, such as, but not limited to, a spring, shock or means of recoil, is included in the device to provide a restoring force to return the first end to the first position when displaced toward the second position by the towing drag force of the towed watersports enthusiast.

The device may provide the towed watersports enthusiast with a burst of additional speed upon demand. The device may allow the towed watersports enthusiast to store energy in the recoil device and fully control the amount of such stored energy that is released to the towed watersports enthusiast moment by moment. The tension of the recoil device may be adjustable to the towed watersports enthusiast's individual preference.

One embodiment is a recoiling pylon mounted generally vertically in the water craft, the top end of which includes the rope attachment point, and the bottom end of which is attached to the water craft by a pivot. The bottom end may be attached to any of a variety of suitable surfaces of the watercraft including but not limited to a deck, a floorboard, a transom, a motorbox, or a tower. The attachment to the water craft may be by any of a variety of suitable means including but not limited to screws, bolts, welding, or integral construction. The attachment may be fixed or removable. The pylon can move towards the towed watersports enthusiast as the drag on the towline increases, such as by cutting in any direction with respect to the water craft. Upon decreasing the drag on the towline, such as by leaving the surface of the water, the towed watersports enthusiast causes the pylon to release energy stored therein to provide a boost in speed to the towed watersports enthusiast relative to the speed of the towing water craft, which can be used by the watersports enthusiast to prolong the time above the surface of the water.

In another embodiment, the device is mounted to an existing tower fixed to the watercraft, which provides the normal attachment point for the towline. A pivot plate pivotably attached to the tower supports a recoil device, such as, but not limited to, a spring, shock, or other means of recoil, and one or more lever arms. The recoil device may extend between the pivot plate and the lever arm or arms. The rope attachment point is attached at a top end of the lever arms, which are, at their bottom end, pivotably attached to the pivot plate. The pivot plate may rotate in a generally horizontal plane as the towline is pulled left or right with respect to the direction of the towed watersports enthusiast. The rope attachment point, and hence the towline, may move a horizontal distance d from a first position to a second position of the plurality of lever arms, even as the pivot plate rotates around its vertical axis. A pressurized air line may supply an adjustable air pressure to a pneumatic shock absorber, such that the recoil force of the shock absorber is adjustable to each towed watersports enthusiast's preference.

In an alternate embodiment, the device may be integrated with a vertically raised tower. The lever means may be a plurality of segmented rods, each lever means including a pivot between the first and second ends thereof. The second end of each lever means may be attached to the water craft using a suitable attachment means to attach the second end to a suitable surface such as but not limited to a pylon, tower, motorbox, or transom of the watercraft. Each lever means further includes a recoil support base attached to the second end of each lever means, proximate to the pivot means at one end of the recoil support base. A second end of each recoil support base is attached to the water craft. In this embodiment, the recoil devices may each be pneumatic shock absorbers, or the like. Each recoil device may have one end attached to the first end of one of the plurality of lever means and a second end attached to one of the recoil support bases. Each recoil support base and the second end of each lever means may form a triangular support with the water craft, providing a strong vertically-raised base upon which to support the first end of each lever means and the rope attachment point. A cross bar may be formed between the first end of each lever means, upon which the rope attachment point may be fixedly mounted proximate to the center thereof. The recoil force of each pneumatic shock absorber may be adjusted through a pressurized air tube controlled by the operator of the water craft or other passenger.

FIG. 1 illustrates an embodiment of the invention that provides a rope attachment point, such as a tow spool 320, for a water craft 310, such as a tow boat, to which is attached a towline 315 for towing a towed watersports enthusiast engaged in a water sport such as, but not limited to, water skiing or wake boarding. The tow spool 320 is supported by a first end of a lever arm, such as a pylon 380. The tow spool 320 is configured to provide an attachment for the towline 315. The opposing second end of the lever arm 380 is pivotally coupled to the tow boat 310 by a pivot 360, such as by a pin and clevis, a ball joint, or a flexible connector. (A portion of the side of the tow boat 310 is shown broken away to allow the connection of the pivot to the tow boat to be seen.) The pivot assembly may be permanently or removably mounted to a floorboard 312 of the tow boat 310. The pivot may include a removable pivot pin to permit the pylon 380 to be removed from the pivot assembly when not in use.

The pivot 360, or other flexible connection, permits the tow spool 320 and the first end of the lever arm 380 to move at least forward and backward generally along the longitudinal axis of the tow boat. This allows the tow spool 320 to move toward and away from the towed watersports enthusiast relative to the tow boat 310. The pylon 380 may be supported in a generally vertical position relative to the floorboard 312 by three or more supports. At least one of the supports includes a recoil device such as, but not limited to, a coil spring, an air-bag spring, a recoiling rubber block, a recoiling rubber rod, a pneumatic air spring or shock absorber, a bungee cord, or other means of recoil.

Figure 2:
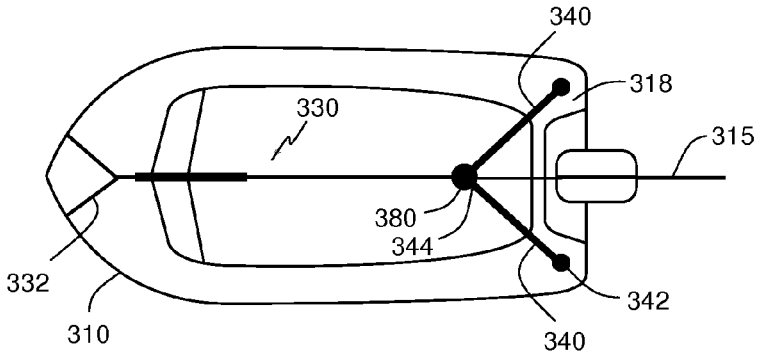
FIG. 2 is a top view of a rope attachment point similar to the one of FIG. 1 shown with a water craft.

In the embodiment shown in FIGS. 1 and 2, the pylon 380 is supported by a resilient bowline 330 and two resilient struts 340. As may be seen in the top view of FIG. 2, the bowline 330 and two resilient struts 340 provide a three point structure for the pylon 380. The recoil device 330, 340 is coupled to the water craft 310 at one end and coupled to the lever arm 380 at the opposing end. The recoil device 330, 340 stores energy as a towing drag force is applied to the tow spool 320 by the towline 315 to cause the lever arm 380 to move from a first position to a second position. The recoil device 330, 340 then provides a restoring force to cause the lever arm 380 to move from the second position to the first position as the towing drag force from the towline 315 is reduced.

A first end of the bowline 330 may be attached in the general vicinity of the bow 314 of the tow boat 310 by any of a variety of means, such as by a loop of rope or webbing 332 as shown. The loop 332 may pass through a ring 316 attached to the hull of the tow boat 310. An opposing second end of the bowline 330 may be attached to the pylon 380 toward the first end near the tow spool 320. The second end of the bowline 330 may be attached to the pylon 380 by any of a variety of means, such as connection to a ring 382 attached to the pylon 380 as shown. The bowline 330 may be attached to the pylon 380 by a removable coupling. At least a portion of the bowline 330 may be in the form of a resilient recoil device 334. The recoil device 334 included in the bowline allows the bowline to lengthen in tension as the tow spool 320 moves aft and provides a restoring force to move the tow spool forward and restore the pylon 380 to the generally vertical position.

A first end 342 of each of the struts 340 may be flexibly attached to the deck 318 in the general vicinity of the transom of the tow boat 310 by any of a variety of means, such as a clevis pin which may act as a pivot point. An opposing second end 344 of each of the struts 340 may be flexibly attached to the pylon 380 toward the first end supporting the tow spool 320, preferably at or above the midpoint of the pylon. The second end 344 of each of the struts 340 may be attached to the pylon 380 by any of a variety of means, such as a ball joint or a hitch pin. Each of the struts 340 may be in the form of a resilient recoil device. The recoil device of the struts 340 allows the struts to shorten in compression as the tow spool 320 moves aft and provide a restoring force to extend the struts and move the tow spool forward and restore the pylon 380 to the generally vertical position. The struts 340 may be preloaded when fully extended to provide the pylon 380 some degree of stability when in the generally vertical position. The bowline 330 may be in some tension when the pylon 380 is in the generally vertical position to further contribute to this stability.

Figure 3:
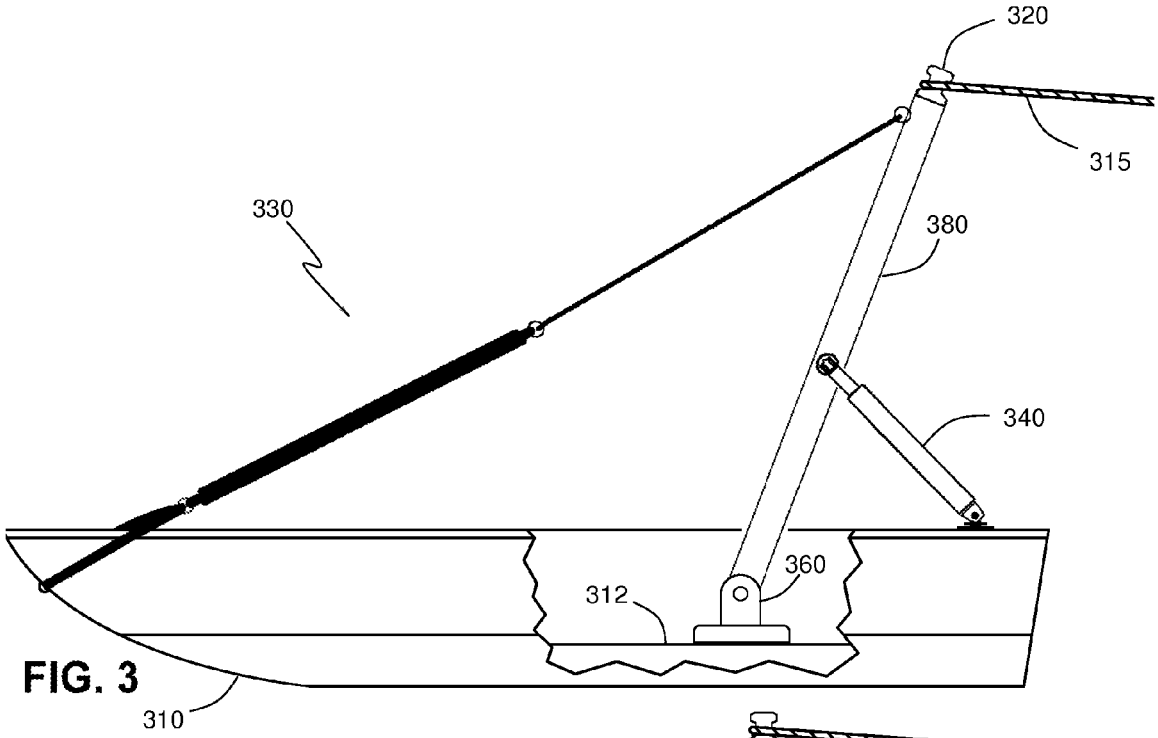
FIG. 3 is a side elevation of the rope attachment point shown in FIG. 1 as it might appear with a drag force being exerted by a towed watersports enthusiast.

The use of a recoil device in one or more of the supporting members that hold the pylon 380 in the generally vertical position provides a water sport tow attachment with recoil. If the towed watersports enthusiast increases the drag on the towline 315, such as by pulling on the towline 315 while turning away from the water craft 310, the bowline 330 will be extended in tension and the struts 340 will be compressed as illustrated by FIG. 3. Upon decreasing the drag on the towline 315, the bowline 330 and the struts 340 may release energy stored therein to restore the pylon toward the generally vertical position and provide a boost in speed to the towed watersports enthusiast relative to the speed of the tow boat 310 by moving the tow spool 320 away from the towed watersports enthusiast relative to the tow boat.

Figure 4:
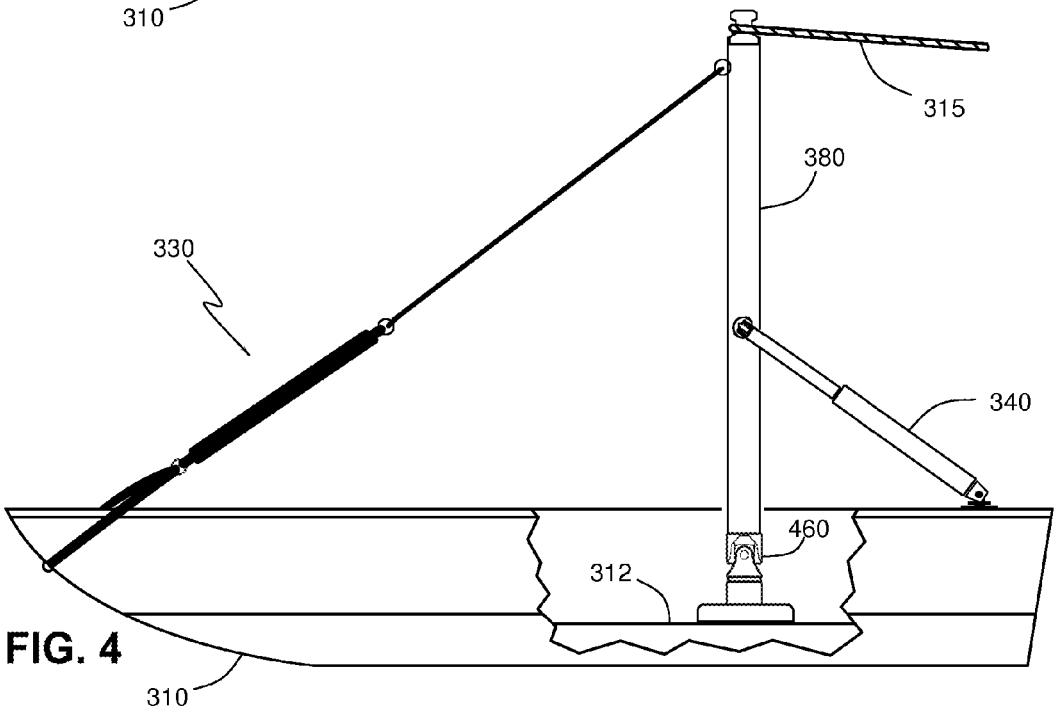
FIG. 4 is a side elevation of another rope attachment point that embodies the invention shown with a water craft.

In another embodiment illustrated by FIG. 4, the flexible connection of the pylon 380 to the deck 312 of the tow boat 310 is by means of a universal type joint 460. This permits the pylon 380 and the supported two spool 320 to move side to side as well as forward and backward within the limits of motion permitted by the struts 340. It will be appreciated that when the struts 340 are fully extended and the pylon is in the generally vertical position, the struts will prevent sideward movement of the pylon 380. As the struts 340 are compressed the pylon 380 will be able to move side to side.

Figure 5:
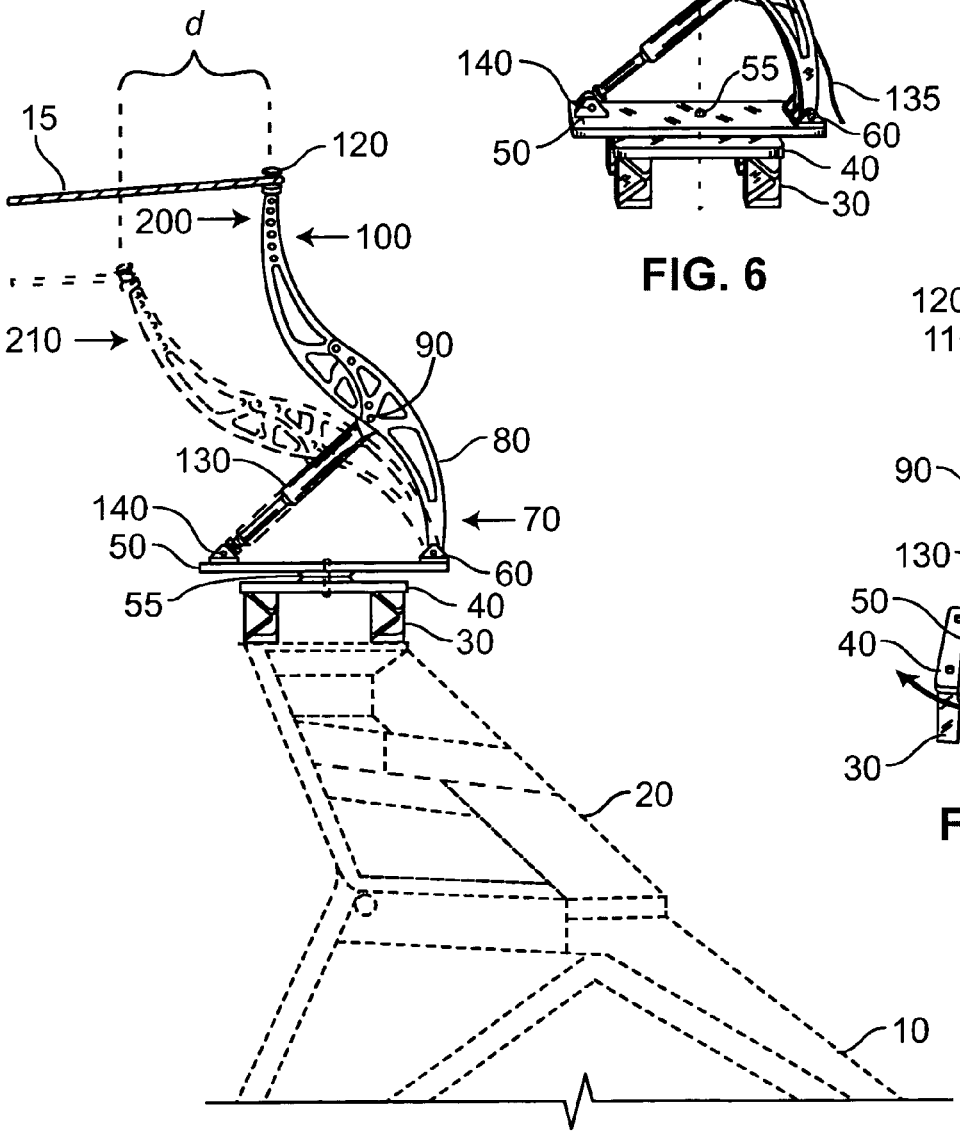
FIG. 5 is a side elevation of another rope attachment point that embodies the invention shown with a water craft, such as a tow boat, that includes an existing tower structure.

FIG. 5 illustrates another embodiment of the invention that provides a rope attachment point 120 of a water craft 10, such as a tow boat, to which is attached a towline 15 for towing a towed watersports enthusiast engaged in a water sport, such as water skiing or wake boarding. This embodiment is shown on a tow boat 10 that is equipped with a structure, such as a tower 20, to elevate the rope attachment point 120. This embodiment may also be attached directly to a deck surface of the tow boat 10.

A lever arm 80 is attached at a first end 100 to the rope attachment point 120, and at a second end 70 to the tower 20 fixed thereto. The second end of the lever arm 80 is flexibly connected to the structure such as by a pivot 60. The pivot 60, or other flexible connection, permits the first end 100 of the lever arm 80 to move between a first position 200 and a second position 210, the second position 210 being horizontally closer to the towed watersports enthusiast by a distance d. A recoil device 130 is included that may maintain the first end 100 in the first position 200 when no load is being applied to the lever arm 80. The recoil device 130 may be any suitable recoil device such as, but not limited to, a coil spring, an air-bag spring, a recoiling rubber block, a recoiling rubber rod, a pneumatic air spring or shock absorber, or other means of recoil.

An embodiment of the invention may provide a recoiling pylon 80 mounted substantially vertically in the water craft 10 (not shown), the top end 100 of which may include the rope attachment point 120, and the bottom end 70 of which may be attached to the water craft 10 or to a structure mounted to the water craft 10, such as a tower 20. The recoil device 130 may be built into the length of the recoiling pylon 80 by virtue of the pylon 80 being resilient. The pylon 80 may allow the rope attachment point 120 to move towards the towed watersports enthusiast as the towed watersports enthusiast increases the drag on the towline 15, such as by pulling on the towline 15 while turning away from the water craft 10. Upon decreasing the drag on the towline 15, the pylon 80 may release energy stored therein to provide a boost in speed to the towed watersports enthusiast relative to the speed of the water craft 10 by moving the rope attachment point 120 away from the towed watersports enthusiast and toward the initial position of repose for the pylon.

In the embodiment shown in FIG. 5, the recoiling pylon 80 is mounted to an existing tower 20 of the watercraft. The recoiling pylon 80 provides the rope attachment point 120 to which the towline 15 is mounted. A tower attachment 30 supports a tower base 40, both of which may be made of a rigid material such as a metallic alloy, fiberglass, or the like. The tower attachment 30 may be a number of upright supports welded or bolted to the tower 20, or affixed to the tower 20 by any other suitable means. The tower base 40 may provide a surface for coupling a device that embodies the present invention to a water craft 10 in a vertically elevated position above the surfaces of the water craft.

Figure 6:
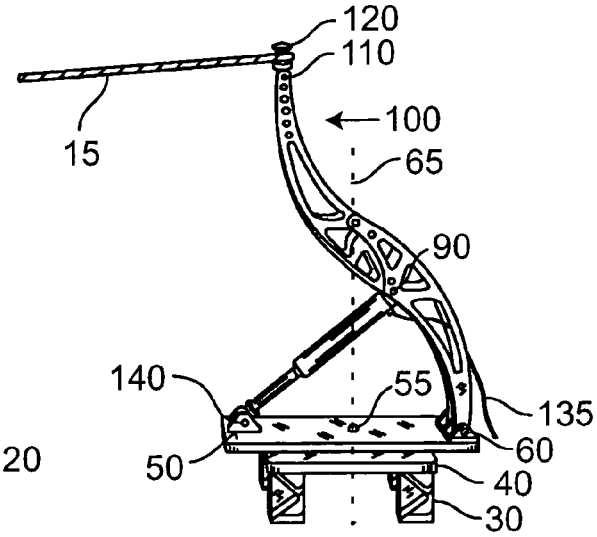
FIG. 6 is a perspective view illustrating a pivotal base and the means by which the base is attached to a lever means and a recoil device.
Figure 7:
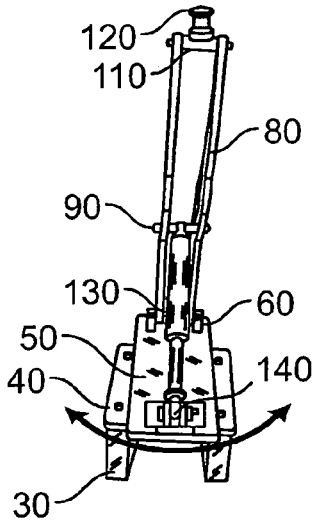
FIG. 7 is a perspective view, illustrating the rotational path that the pivot base may take with respect to the tower base and tower mounts.

The tower base 40 may provide a pivot 55, such as a ball bearing assembly or other suitable pivot mechanism, which in turn supports a pivot plate 50. The pivot plate 50 is free to rotate around an axis 65 that is generally perpendicular to a deck of the water craft (FIGS. 5, 6 and 7), in a generally horizontal plane. The pivot may allow the lever arm 80 to follow the towed watersports enthusiast as they traverse the wake of the towing water craft 10. The bearings 55 may be sealed to resist entry of water or salt that may corrode the bearings. The bearings 55 may be permanently lubricated.

The pivot plate 50 may be made from a relatively thick metallic alloy or fiberglass plate, or any other suitable material that is rigid and strong enough to withstand the significant forces applied thereto during use and to resist the elements associated with boating. The pivot plate 50 supports the recoil device 130 and a lever arm 80, as FIGS. 2 and 3 illustrate. The lever arm may be formed as a single piece or as multiple pieces that act in unison. The second end 140 of the recoil device 130 is attached to the pivot plate 50, such as through a welded or bolted attachment plate, and the second end 70 of each lever arm 80 is attached to an attachment 160 that itself is welded to the pivot plate 50.

The recoil device 130, such as a pneumatic shock absorber 130, is positioned between the pivot plate 50 and a central attachment point 90 of the lever arm 80. The first end 100 of the lever arm 80 is connected to the rope attachment point 120, such that the rope attachment point 120 is on the towed watersports enthusiast side of the vertical axis 65 of the device. As such, the pivot plate 50 may rotate as the towline 15 is pulled left or right with respect to the direction of the water craft 10. Moreover, the rope attachment point 120, and hence the towline 15, may move a horizontal distance d from the first position 200 to the second position 210 of the pair of lever arms 80, even while the pivot plate 50 rotates around its vertical axis 65.

In one embodiment, a pressurized air line 135 (FIG. 6) may be provide to supply an adjustable air pressure to the pneumatic shock absorber 130, such that the recoil force of the shock absorber 130 may be adjustable to each towed watersports enthusiast's preference. The pressurized air line 135 may be a flexible tube, or the like. The air pressure within may be controlled by the operator of the water craft 10 (not shown) or a passenger.

In another embodiment, the central attachment point 90 of the lever arm 80 may be adjustable, thereby altering the recoil force experienced by the towed watersports enthusiast.

In one embodiment, the pneumatic shock absorber 130 may be of a type that has very little dampening action, and principally acts as an efficient spring. In another embodiment, the pneumatic shock absorber 130 may be of a type that has a greater dampening action, which may be adjustable, and may permit the rate of recoil to be adjusted.

Figure 8:
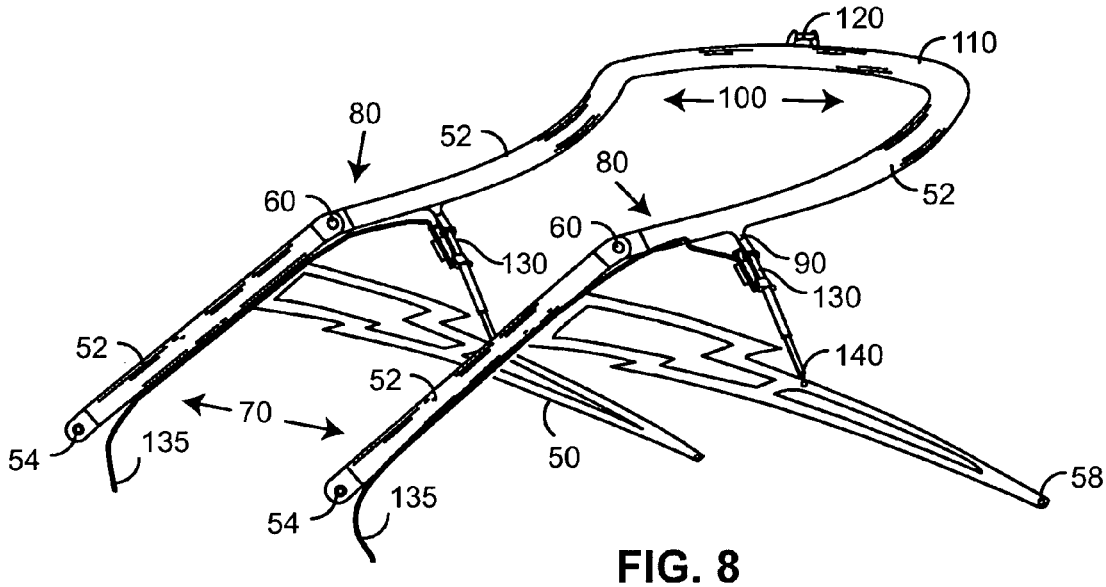
FIG. 8 is a perspective view of an alternate embodiment of the invention, wherein the invention is integrated into a tower structure.
Figure 9:
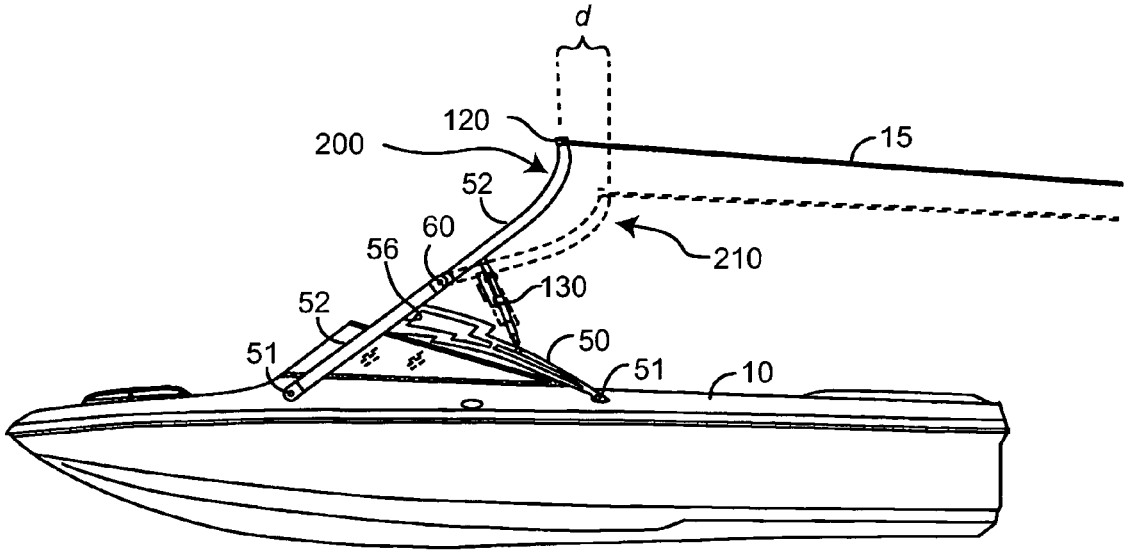
FIG. 9 is a side elevation of the alternate embodiment, illustrating a first and second positions of a rope attachment point attached to the top of the lever means thereof.

In an alternate embodiment, illustrated in FIGS. 8 and 9, the tower 20 is combined with the present invention. The lever arm 80 is a plurality of segmented rods 52, each lever arm 80 including a pivot 60 between the first and second ends 100, 70 thereof. The second end 70 of each lever arm 80 is attached to the water craft 10 using a suitable attachment 51, such as a bolt (FIG. 9) secured through a mounting hole 54 (FIG. 8) in the second end 70 of each lever 80. Integrating the pivot 60 into the tower 20 may vertically elevate the pivot above the water craft to a position where the water craft does not provide any structure that could support the pivot.

Each lever 80 further includes a recoil support base 50 attached to the second end 70 of each lever 80, proximate to the pivot 60 at one end 56 of the recoil support base 50. A second end 58 of each recoil support base 50 is attached to the water craft 10 using a suitable attachment device, such as a bolt 51. Preferably the recoil support base 50 is made from a suitably strong and rigid material, such as but not limited to metal, fiberglass, or the like, and is formed into an aesthetically pleasing shape, such as the lightening bolt design shown in FIGS. 8 and 9. The lever 80 is preferably formed from a strong metallic rod and either powder coated or otherwise covered to protect it from the elements, or a suitably strong fiberglass or plastic rod material.

In this alternate embodiment, the recoil devices 130 are each pneumatic shock absorbers, or the like, each having one end 90 thereof attached to the first end 100 of one of the plurality of lever 80. A second end 140 of each of the shock absorbers 130 are attached to one of the recoil support bases 50. As such, each recoil support base 50 and the second end of each lever 80 form a triangular support with the water craft 10, providing a strong base upon which to support the first end 100 of each lever 80 and the rope attachment point 120. A cross bar 110 is formed between the first end 100 of each lever 80, upon which the rope attachment point 120 is fixedly mounted, such as by fastening or welding, proximate to the center thereof. Further, in the alternate embodiment the recoil force of each pneumatic shock absorber 130 can be adjusted through a pressurized air tube 135 controlled by the operator of the water craft 10 or another passenger. The pressurized air tube 135 is preferably a flexible hose or air fitting, thereby allowing the device to fold down at pivot points 60.

It will be appreciated that the attachment device 51 to the water craft may be a bolt or some other suitable attachment means. For example, if the user of the device of the present invention desires to be able to easily remove the device, a temporary attachment device well known in the prior art may be used, provided such temporary attachment device firmly holds the lever arms 80 and the recoil support bases 50 to the water craft 10 during use.

While a particular form of the invention has been illustrated and described, it will be apparent that various modifications can be made without departing from the spirit and scope of the invention. For example, in the embodiment of the invention illustrated in FIGS. 5 to 7, the pivot 55 and the pivot plate 50 may be omitted. Further, various materials may be used to construct the components, and the form of the lever arms 80 and the tower base 40 may be changed from those shown in the Figures. A finely shined chrome or chrome plated metal may be used for an aesthetically pleasing apparatus that may enhance the visual appearance of the tow boat 10. Accordingly, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A device comprising:

a pivot coupled to a water craft;

a lever arm pivotally coupled to the pivot at one end;

a tow spool coupled to the lever arm at an end opposite the pivot, the tow spool configured to provide an attachment for a towline; and a pneumatic shock absorber coupled to the water craft at one end and coupled to the lever arm at the opposing end, the pneumatic shock absorber adapted to store energy as a towing drag force is applied to the tow spool to cause the lever arm to move from a first position to a second position and to provide a restoring force to cause the lever arm to move from the second position to the first position as the towing drag force is reduced, the restoring force being pneumatically adjustable by a pressurized air line.

2. The device of claim 1 further comprising a pivot plate pivotally coupled to the water craft wherein the pivot and one end of the pneumatic shock absorber are coupled to the water craft by means of the pivot plate such that the lever arm may rotate relative to the water craft about an axis that is generally perpendicular to a deck of the water craft.

3. The device of claim 2 wherein the pivot plate is coupled to the water craft by a structure that vertically elevates the pivot plate above the surfaces of the water craft.

4. The device of claim 1 wherein the pneumatic shock absorber is adjustably coupled to the lever arm to provide an adjustable restoring force.

5. The device of claim 1 wherein the pivot is coupled to the water craft by a structure that vertically elevates the pivot above the surfaces of the water craft.

6. A device for use in a water craft towing a towed watersports enthusiast engaged in a water sport, the towed watersports enthusiast being towed by a towline attached to the water craft at a rope attachment point, the device comprising:

a plurality of lever means each having at a first end a means for attaching to the rope attachment point, the lever means each having at a second end a means for attaching to the water craft, the first end of each lever means being movable from a first position to a second position, the second position being horizontally distal from the first position in the direction of the towed watersports enthusiast, wherein the plurality of lever means is a plurality of segmented rods, each rod including a pivot means between the first and second ends thereof, each lever means further including a recoil support base attached to the second end of the lever means proximate to the pivot means at one end and to the water craft at a second end; and a plurality of recoil means for preferentially maintaining the first end of each lever means in the first position, the recoil means having one end attached to the first end of the lever means proximate to the pivot means, the recoil means having a second end attached to the recoil support base, whereby the first end of the lever means may pivot around the pivot means between the first and second positions;

whereby the towed watersports enthusiast may store energy in the recoil means by creating additional drag on the towline, and then release said stored energy in the recoil means by reducing drag on the towline.

7. The device of claim 6 wherein the lever means is a recoiling pylon, mounted generally vertically onto the water craft at the second end thereof, the rope attachment point being formed in the first end thereof.

8. The device of claim 6 further including a tower attachment means for holding a tower base fixed in relation to the tower, the base further including a pivot means for pivotably supporting a pivot plate such that the pivot plate may rotate with respect to a vertical axis, the second end of each lever means attached to one end of the pivot plate, the recoil means having one end attached to the lever means, the recoil means having a second end attached to the pivot plate.

9. The device of claim 8 wherein the plurality of lever means is exactly two and the rope attachment point attachment means is a cross bar held between each one end of both lever means, the rope attachment point being fixed on the cross bar.

10. The device of claim 9 wherein the recoil means is a pair of pneumatic shock absorbers, the recoil tension of each shock absorber being pneumatically adjustable by a pressurized air line.

11. The device of claim 8 wherein the recoil means is a pneumatically adjustable shock absorber, the recoil tension of the shock absorber being pneumatically adjustable by a pressurized air line.

12. A device for use in a water craft towing a towed watersports enthusiast engaged in a water sport, the towed watersports enthusiast being towed by a towline attached to the water craft at a rope attachment point, the device comprising:

a plurality of lever means each having at a first end a means for attaching to the rope attachment point, the lever means each having at a second end a means for attaching to the water craft, the first end of each lever means being movable from a first position to a second position, the second position being horizontally distal from the first position in the direction of the towed watersports enthusiast;

a plurality of recoil means for preferentially maintaining the first end of each lever means in the first position; and a tower attachment means for holding a tower base fixed in relation to the tower, the base further including a pivot means for pivotably supporting a pivot plate such that the pivot plate may rotate with respect to a vertical axis, the second end of each lever means attached to one end of the pivot plate, the recoil means having one end attached to the lever means, the recoil means having a second end attached to the pivot plate;

whereby the towed watersports enthusiast may store energy in the recoil means by creating additional drag on the towline, and then release said stored energy in the recoil means by reducing drag on the towline.

13. The device of claim 12 wherein the recoil means is a pneumatically adjustable shock absorber, the recoil tension of the shock absorber being pneumatically adjustable by a pressurized air line.

14. A method of providing a boost in speed to a towed water sports enthusiast relative to a speed of a towing water craft, the method comprising:

coupling a pivot to a water craft;

pivotally coupling one end of a lever arm to the pivot;

coupling a tow spool to the lever arm at an end opposite the pivot, the tow spool configured to provide an attachment for a towline;

coupling a recoil device to the water craft at one end and to the lever arm at the opposing end;

applying a towing drag force to the tow spool to store energy in the recoil device by causing the lever arm to move from a first position to a second position; and reducing the towing drag force to cause the lever arm to move from the second position to the first position and provide the boost in speed to the towed water sports enthusiast sufficient to prolong the time the towed watersports enthusiast is above the surface of the water.

15. The method of claim 14 further comprising pivotally coupling a pivot plate to the water craft wherein the pivot and one end of the recoil device are coupled to the water craft by means of the pivot plate such that the lever arm may rotate relative to the water craft about an axis that is generally perpendicular to a deck of the water craft.

16. The method of claim 15 wherein the pivot plate is coupled to the water craft by a structure that vertically elevates the pivot plate above the surfaces of the water craft.

17. The method of claim 14 further comprising moving the coupling of the recoil device to the lever arm to adjust a restoring force of the recoil device.

18. The method of claim 17 wherein the recoil device is a pneumatic shock absorber, the method further comprising adjusting the restoring force by adjusting an air pressure.

19. The method of claim 14 wherein the pivot is coupled to the water craft by a structure that vertically elevates the pivot above the water craft.

* * * * *